United States Patent [19]

Cooper

[11] Patent Number: 4,716,357

[45] Date of Patent: Dec. 29, 1987

[54] AC VOLTAGE REGULATOR WITH SPLIT PRIMARY SWITCHING

[76] Inventor: Edward Cooper, 2612 Penrose St., San Diego, Calif. 92101

[21] Appl. No.: 922,196

[22] Filed: Oct. 23, 1986

Related U.S. Application Data

[63] Continuation-in-part of Ser. No. 805,829, Dec. 6, 1985.

[51] Int. Cl.[4] ..... G05F 1/30

[52] U.S. Cl. ..... 323/263; 363/101

[58] Field of Search ..... 363/90, 101; 323/259, 323/261-263, 255, 258, 344

[56] References Cited

U.S. PATENT DOCUMENTS

| | | | |
|---|---|---|---|
| 2,063,693 | 12/1936 | McCarty | 323/259 |
| 2,753,512 | 7/1956 | Helterline | 323/263 |
| 3,370,223 | 2/1968 | Senetcen | 323/263 |
| 3,490,030 | 1/1970 | Kelley | 323/263 |
| 3,621,375 | 11/1971 | Kettler | 323/262 |
| 3,732,486 | 5/1973 | Schoendube | 323/263 |
| 3,970,918 | 7/1976 | Cooper | 323/258 |
| 4,466,039 | 8/1984 | Moran et al. | 361/35 |

FOREIGN PATENT DOCUMENTS

| | | | |
|---|---|---|---|
| 257838 | 3/1928 | Italy | 323/263 |
| 534742 | 3/1977 | U.S.S.R. | 323/263 |

*Primary Examiner*—William H. Beha, Jr.

*Attorney, Agent, or Firm*—Brown, Martin, Haller & Meador

[57] ABSTRACT

An apparatus for AC line voltage regulation has an input port for connection to an AC source, an output port for connection to a load, and a transformer assembly connected between the input and output ports. The transformer assembly comprises a buck/boost winding and a primary winding wound about a common transformer core, and a switch arrangement for controlling the connection of the primary winding in circuit with the buck/boost winding. The switch arrangement is controlled by switch actuators responsive to a voltage sensor assembly to connect the primary winding in either of two possible conditions when the voltage is outside predetermined limits. The transformer assembly comprises either a step down transformer for reducing or bucking the output voltage or a step up transformer for boosting the output voltage according to the condition of the switch arrangement. The primary may comprise separate windings controlled by the switching assembly for connection in different configurations.

21 Claims, 10 Drawing Figures

AC VOLTAGE REGULATOR WITH SPLIT PRIMARY SWITCHING

This is a continuation-in-part of Application Ser. No. 805,829 of the same Applicant, filed Dec. 6, 1985 and entitled "AC LINE VOLTAGE REGULATOR," now abandoned.

BACKGROUND OF THE INVENTION

The present invention relates generally to the control of AC line voltage, and more specifically to AC voltage regulation apparatus of the transformer switching type.

Ever since AC power has been used to operate critical electronic equipment there has been a need to regulate the power in order to protect the equipment against voltage sags and destructive surges. Electronic equipment has become more sophisticated over the years, and now includes computers with high speed logic circuits which are extremely sensitive to variations in the power supply level. Thus there are now many types of apparatus available for AC power regulation.

One of the solid state devices which has been available for many years and which is recognized as one of the highest performance power protection devices is known in the art as the Multi Primary Switching (MPS) Line Conditioner. Such a device is described in my U.S. Pat. No. 3,970,918.

The MPS technique utilizes several primary windings on a common magnetic transformer core, as well as a very low impedance buck/boost winding on the same core which is conncted between the input and output of the apparatus so that a regulated voltage appears at the output. Each of the primary windings has a designed-in turns ratio and winding direction so that buck, or boost, or straight through operating modes can be achieved by selectively terminating a corresponding primary winding. Buck or boost modes are achieved by terminating the corresponding primary winding to the AC power via switching devices. Straight-through operation is achieved by terminating one of the primary windings to itself, i.e. by using the mutual inductance of transformer windings to reflect a short circuit in the buck/boost winding. Input or output voltage detection techniques which are well known in the art are used to activate the appropriate switches.

The MPS line conditioner can achieve outstanding performance, and has inherent current protection under momentary latch up conditions which can occur when two switches are conducting simultaneously. This is because the total resistance in the primary winding is reflected into the buck/boost winding by the impedance ratio of the windings. The impedance ratio is the square of the turns ratio, and this would be 100:1 if the turns ratio is 10:1. Thus the winding resistance has only an insignificant effect on the output regulation of the device while it provides substantial protection for the switches or switching devices. This means that the MPS line regulator has inherent protective features in other types of regulators during tap changing or ranging steps.

In spite of the inherent current protection in this type of regulator, there are two types of failure which can occur as the result of the transformer turns and impedance ratios. The first type of failure can occur at the instant power is turned on while electric equipment is already connected at the output. The second type of failure can occur while power is already on, at the instant an extremely large load at the output is turned on.

The first type of failure results from the fact that in solid state devices all circuits, including switches, are initially inoperative for a brief moment when power is first turned on, or restored following a power cut. If the power is turned on at a peak in the input power sine wave, the peak line voltage is impressed on the buck/boost winding. If the turns ratio is 10:1, ten times this voltage will appear across the three open switches, which may easily cause destruction of the semiconductor switches.

The second type of failure occurs when the regulator is operating in any one of its normal modes at the time when a heavy equipment load is being connected to its output. It can happen that the initial surge current causes a current flow through the buck/boost winding which opposes the current flowing through the particular connected primary winding at that instant. This opposing current can be so large that the switching device is destroyed.

SUMMARY OF THE INVENTION

According to the present invention an AC voltage regulating apparatus is provided having an input port for connection to a voltage source and an output port for connection to a load. The apparatus comprises a transformer assembly including a buck/boost winding and a primary winding wound on a common transformer core, with the buck/boost winding connected between the input and output port. A switch assembly is provided for controlling the connection of the primary winding in circuit with the buck/boost winding in accordance with the magnitude of the line voltage. The switch assembly connects the primary winding in a first direction when the voltage is above a first predetermined level so that the transformer assembly comprises a step down transformer for reducing the voltage, and connects the primary winding in the opposite direction in response to voltages below a second predetermined level so that the transformer assembly comprises a step up transformer for boosting or increasing the voltage. The switch assembly is preferably arranged to terminate the primary winding to itself when the voltage is within predetermined limits so that the transformer assembly operates in a straight-through mode. An energy proportional current and voltage limiting circuit is provided for limiting the voltage and power across the primary winding.

Thus a primary switching transformer is provided which requires only a single primary winding, significantly reducing the size, weight and materials cost of the apparatus while being of equivalent efficiency to larger scale voltage regulators.

An energy proportional clamping circuit is preferably connected in parallel across the primary winding for limiting the maximum possible voltage which may develop across the winding when all the switches of the switching assembly are open.

Instead of connecting a single primary winding in opposite directions, the primary winding may comprise two oppositely wound portions, with the switch assembly arranged to connect the opposite portions selectively in the circuit.

According to one embodiment of the invention, the switching assembly comprises a first pair of switches for selectively connecting opposite ends of the primary winding to a common tap point on the primary winding, and a second pair of switches for selectively connecting opposite ends of the primary winding to a common line, which may be the circuit neutral line. A suitable control assembly is provided to control the closing of respective switches, and the control assembly is responsive to the line voltage level, measured at the circuit input or output, to control the mode of operation of the apparatus. The control assembly is arranged to close one switch of the first pair and the opposite end switch of the second pair connected to the opposite end of the primary winding in response to voltages above the first predetermined level, with the primary winding direction being such that the apparatus operates in the buck, or voltage reducing mode, when these switches are closed. The control assembly is arranged to closed the other switch of each pair in response to voltages below the second predetermined level so that the apparatus operates in the boost mode, and to close both switches of the second pair while the voltage is between these values to terminate the primary winding to itself so that the apparatus operates in a straight-through mode, i.e. input voltage is equal to output voltage.

The common tap point may be an intermediate point on the buck/boost winding, or either end of the winding, with the input and output ports being connected to the respective opposite ends of the winding in the first case and either to the intermediate point and unconnected end of the winding, respectively, or vice versa, in the second case. Alternatively, the switch assembly may be connected to the buck/boost winding via a further winding having a first portion wound in one direction and second portion with more turns than the first wound in the opposite direction. This avoids the necessity of providing a tap on the buck/boost winding.

According to another, preferred embodiment of the invention, the primary winding comprises two oppositely wound portions, and the switch assembly comprises a series of switches for selectively connecting one portion of the primary winding between the buck/boost winding and a circuit common line, or connecting the oppositely would portion between the buck/boost winding and the common line, which may be the circuit neutral line. In this arrangement, the energy proportional clamping circuit is connected between the two primary winding portions. The switches are preferably connected in pairs, one pair controlling the series connection of two parts of the first winding portion, and the other pair controlling the series connection of two parts of the oppositely wound portion. The switches are terminated to the same line, and in the straight through mode one switch of each pair is closed to terminate the primary winding to itself.

BRIEF DESCRIPTION OF THE DRAWINGS

The present invention will be better understood from the following detailed description of same preferred embodiments of the invention, taken in conjunction with the accompanying drawings in which like reference numerals refer to like parts and in which.

DESCRIPTION OF THE PREFERRED EMBODIMENT

Figure 1:
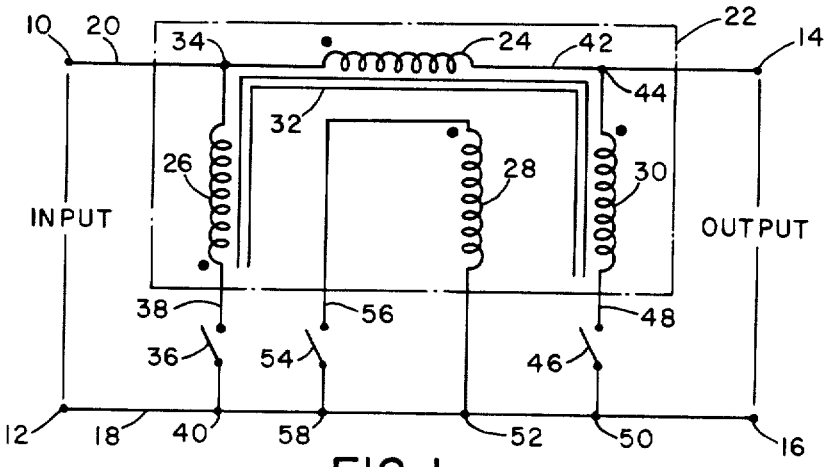
FIG. 1 PRIOR ART
FIG. 1 is a simplified schematic diagram of a prior art multi primary switching circuit.
Figure 2:
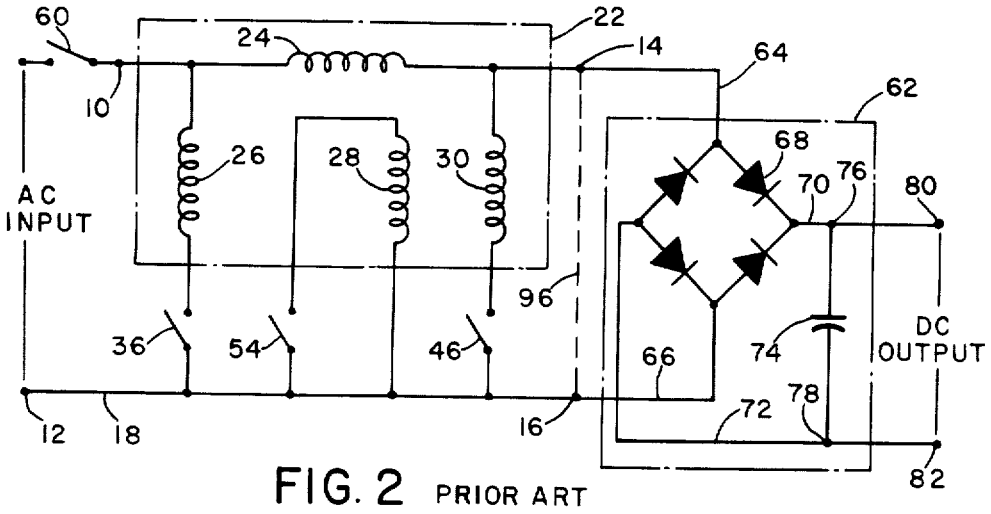
FIG. 2 PRIOR ART
FIG. 2 is a schematic diagram of the circuit of FIG. 1 shown connected to a typical input rectifier circuit of the load which is connected to the regulator's output.

FIGS. 1 and 2 show a prior art multi primary switching (MPS) line conditioner or regulator which will be described first for better understanding of the present invention.

In FIG. 1, there are two input ports 10 and 12, which are the input terminals of the MPS regulator. Port 10 is connected to the live input LINE voltage (120 V rms in the U.S.A.), and input port 12 is connected to NEUTRAL power input. The Neutral is carried through one of two regulator output terminals or ports 14, 16 via a circuit common line 18. The live input power connects from port 10 via line 20 to the MPS regulating transformer 22. The transformer has a total of four windings, 24, 26, 28 and 30. All of these windings are wound on the same transformer core 32 so that all of them have a mutual inductance. The winding direction (or polarity) is indicated by dots in a conventional manner, directly adjacent to each winding. Winding 24 is the buck/boost winding which is always a very low impedance design, i.e. it has very few turns of extremely large wire. For a typical example, it may have ten turns. The remaining three windings are the primary windings which have essentially a 1:1:1 turns ratio with respect to each other, and typically a 10:1 turns ratio with respect to the buck/boost winding 24. Thus, if winding 24 has 10 turns, each of windings 26, 28 and 30 have 100 turns.

Winding 26 connects from the input line 20, at point 34, to a switching device, 36, at point 38. The other side of switching device 36 connects to the common line 18, at point 40. If during the operation, switching device or switch 36 is closed, primary winding 26 will be energized by the AC input power, and the turns relationship between windings 26 and 24 is such that this mode of operation achieves a boosted output voltage between the output ports 14 and 16, because the ports are connected across both windings and the transformer is now connected as a step-up autotransformer.

Winding 30 connects between regulator output line 42, at point 44, and another switching device, 46, at point 48. The other side of switch 46 connects to the common line 18, at point 50. The winding relationship between windings 24 and 30 is such that when switch 46 is closed, the two windings will be in series, and energized by the input power. The output ports are connected across winding 30. Consequently, this mode of operation will provide a reduced, or bucked output voltage at the output ports because the transformer is now acting as a step-down autotransformer.

Winding 28 connects between the common line 18 at point 52 and a third switching device, 54, at point 56. The other side of switch 54 also connects to the common line 18, at point 58. If during the operation, switch 54 is closed, the switch provides a short circuit across switch 28. Since no input power connects to this winding, it will not be energized by any power. Instead, it constitutes a shorted winding. But this winding has also mutual inductance with winding 24 so that the short circuit across winding 28 is reflected into the buck-/boost winding 24. However, winding 28 has some Ohmic resistance, and this resistance is reflected into the buck/boost winding by the (reduced) impedance ratio of the windings. The impedance ratio is the square of the turns ratio. In this example, if the turns ratio is 10:1, the impedance ratio is 100:1. Since this is a step-down transformation, the actual winding resistance which is reflected into the buck boost winding 24 is reduced by a factor of 100. Thus, it becomes insignificant. This is in full accordance with the impedance matching theory of transformers. In this case, the transformer operates in a straight through mode, with the input voltage being essentially unchanged. It is to be understood that there are many other circuits in the MPS regulator to sense the output voltage and control the actual operation of the three switches, which will not be described in detail here.

In FIG. 2, the same prior art MPS regulator circuit of FIG. 1 is shown, using like numbers for like elements. However, at the input port 10, there is an input power switch, 60, shown in its open position. Thus, no input power is initially applied to the the system. A rectifier input circuit 62 of typical electronic equipment is shown connected to output ports 14 and 16. It is shown here without any input power transformer because it simplifies this discussion and is totally immaterial in the ultimate failure analysis. Specifically, equipment input lines 64 and 66 connect to a full wave rectifier 68 and the rectified DC outputs connect from the rectifier via lines 70 and 72 to the input DC storage capacitor 74, at points 76 and 78. Lines 70 and 72 continue from the capacitor to the output terminals 80 and 82, where various DC regulators and other circuits in the equipment (not shown) obtain their operating power. All of these circuits constitute the ultimate load, but they are here omitted since they do not add anything to this discussion.

Figure 3:
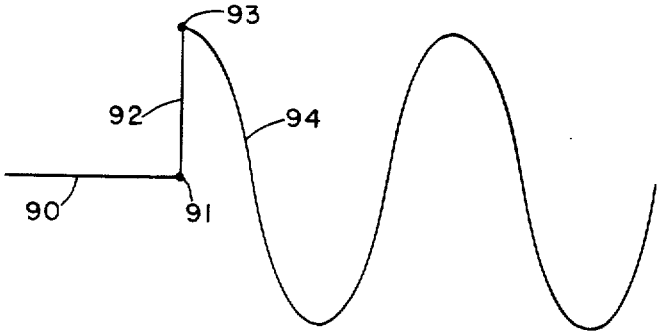
FIG. 3 shows the waveform of the AC input power at the worst possible instant of power up of the circuit.

One of the problems in this type of regulator circuit is the risk of switch failure under certain operating conditions. FIG. 3, shows the waveform of the AC input power between input ports 10 and 12. Line 90 shows no input voltage until it reaches point 91. At that very instant input switch 60 of FIG. 2 is being closed, and this instant happens to be just at the time when the input power sinewave passes through one of its peaks. Thus, there is a sudden rise from point 91 to point 93, shown by line 92. From 93 on, there follows the characteristic sinusoidal voltage waveform as shown by line 94. With reference to FIGS. 2 and 3, as long as switch 60 is open (line 90), the MPS switches 36, 46 and 54 are all open, and since there is no operating input power connected, the rectifier 68 is inoperative, and the storage capacitor 74 is completely discharged to zero volt. At the very instant when switch 60 is being closed, the input voltage between input ports 10 and 12 rises sharply to the peak voltage of the sinewave power, see line 92. Since there is a time delay in the regulator's own electronic power supply and other circuits, the switches 36, 46 and 54 will initially remain open. However, the buck/boost winding 24 connects between the input and output ports so that the rectifier circuit of the equipment provides a termnating impedance at the output ports 14 and 16. Since the input storage capacitor 74 is totally discharged, it appears as such a heavy load impedance that it can be considered a momentary short circuit which forces (or clamps) the output voltage between ports 14 and 16 to almost zero. Thus, the input impedance of the equipment—at that very instant—is indicated in FIG. 2 as a dotted line, 96.

At this point, the full peak line voltage is impressed on the buck/boost winding 24 of the MPS regulator because there is a direct current path from the input port 10, through winding 24 to port 14, through line 96 to the second output port, 16 and from there via line 18 to the input port 12. These are the initial power up conditions at the worst possible point of switching on the equipment. If the input power is the American 120 V rms, the peak voltage can easily have a magnitude of 180 V. If it is a European 240 V rms system, the peak voltage may be 380 V.

It must now be recalled that the turns ratio between the MPS transformer windings is in the order of 10:1. Therefore, if 180 V is impressed on winding 24, there will be ten times as much voltage across each one of the three primary windings, 1,800 V (or 3,800 V in the 240 V systems.) Since all other points in the MPS are terminated, these voltages appear across the three open switches. The initial front, or rise time of this transition is extremely fast, less than one microsecond. This yields a rate of voltage rise of about $2\times10^9$ V per second (or $4\times10^9$ per second respectively.) Such rate of rise to such large voltage is beyond the capabilities of the switching devices so that one of two possible circuit reactions will occur. Either one of the switching devices may trigger itself on so that at least one of the primary windings becomes terminated, and the transformer will then absorb the initial surge energy. In the MPS design, the switching devices can easily handle the currents which can occur at that time. Thus, this response constitutes a desirable event. However, and far more likely, the fast rate of rise to such a large voltage causes puncturing of the semiconductor switches and they are destroyed permanently.

A second failure mode which may occur has the same end effect, but can be caused while the MPS is already properly operating. The same consideratis of the electronic equipment input rectifier circuit characteristics are involved, just as discussed above. Depending on the input voltage conditions at the time when a heavy electronic equipment load is being connected to the regulator output, the regulator may be in any one of its normal operating modes, i.e. buck, or boost, or straight-through mode. Therefore, it can easily happen that the initial (almost short circuit) surge current causes a current through winding 24 which opposes the current which is flowing through the primary winding at that instant. This opposing current is so large that the switching device may be forced to instantaneously respond to a polarity reversal of the current it is conducting. This fast reversal of current flow can cause a brief interruption of conduction, in the order of two microsecond, during which large voltage transients may be induced into the primary windings. Consequently, the same failure mode of puncturing can occur at that time.

Thus even the high performance prior art MPS regulator is subject to failure under certain conditions.

An improved AC line voltage regulator according to a preferred embodiment of the present invention will now be described with reference to FIGS. 4 to 8 of the accompanying drawings.

Figure 4:
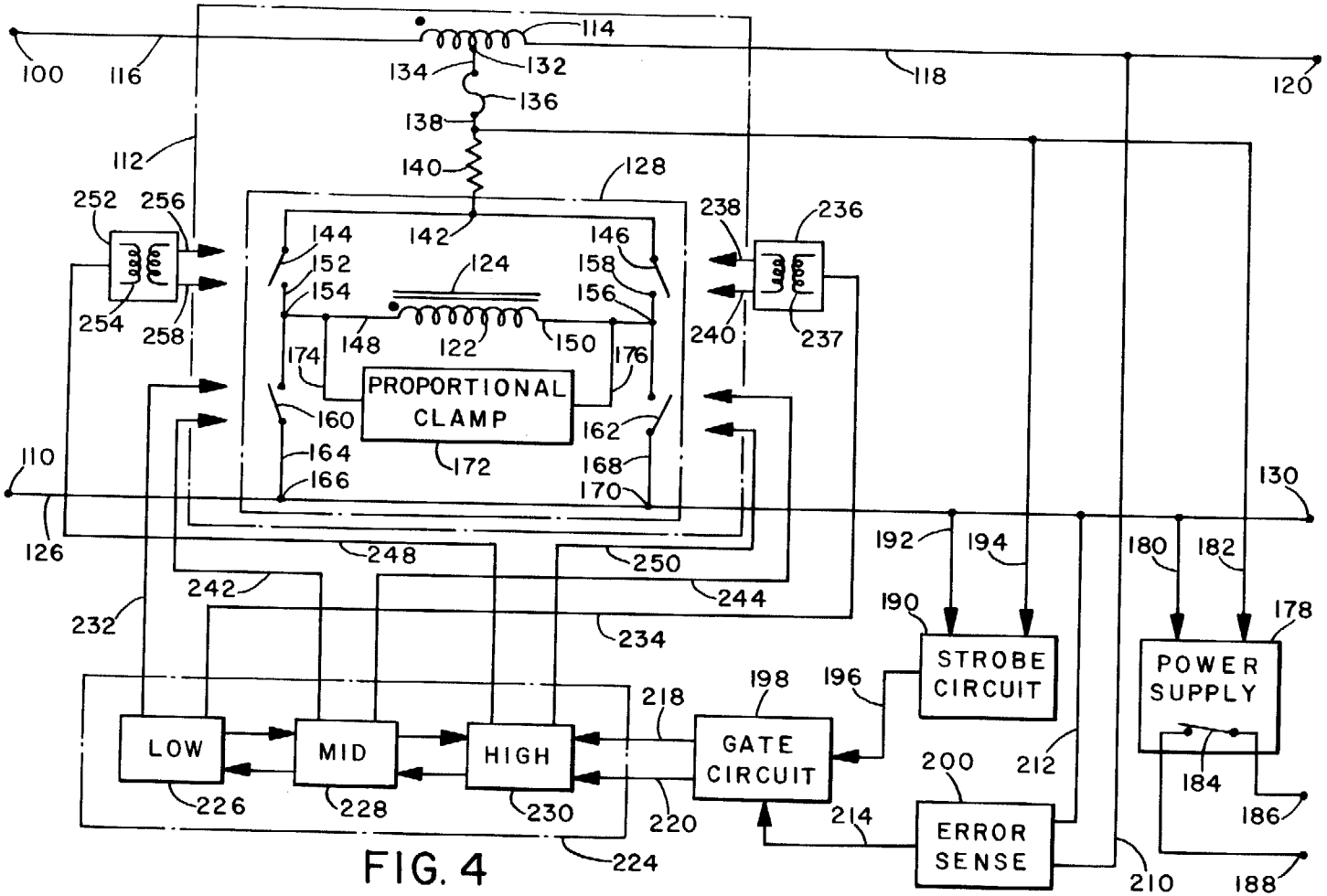
FIG. 4 is a simplified schematic diagram of an AC voltage regulator according to one embodiment of the present invention.

FIG. 4 is a simplified schematic diagram of the overall apparatus or circuit for regulating an AC line voltage. As shown in FIG. 4, the apparatus has two input ports, 100 and 110. Port 100 is for connection to the live AC line voltage, and port 110 is for connection to the neutral of the input AC power.

A transformer assembly 112 is connected to the input. The assembly basically comprises a first transformer winding 114 connected via line 116 to the input port 100 and via line 118 to an apparatus output port 120. A single primary winding 122 wound on a common magnetic transformer core 124 with the first winding 114 is connected between the winding 114 and circuit neutral line 126 by a switching assembly 128. The winding direction is indicated conventionally by dots which are located adjacent windings 114 and 122, indicating in each case the start of the winding and assuming each coil is wound in the same direction.

Switching assembly 128 controls the mode of connection of primary winding 122 in the circuit, as discussed in more detail below. Neutral line 126 connects neutral input port 110 to the other circuit output port 130.

The first winding 114, which constitutes a buck-/boost winding as described below, is connected to the switching assembly 128 via a tap 132 which may be located at any selected position along winding 114. In the drawing, it is shown near the middle of the winding, but alternative positions may be used. The tap 132 connects via line 134 to a fuse 136, and continues from there via line 138 to a resistor 140, the other end of which is connected to the switching assembly at point 142.

The switching assembly basically comprises a first pair of switches 144, 146 which connect opposite ends 148, 150, respectively, of the primary winding to the connection point 142. Thus switch 144 is connected at one side to point 142 and at the other side via line 152 to point 154, which is connected to one end of the winding 122. The other end of the winding connects via point 156 and line 158 to the other switch 146.

The switching assembly further comprises a second pair of switches 160, 162 which connect the respective opposite ends of the primary winding to the neutral line 126. Thus switch 160 is connected at one side to point 154 and at the other side via line 164 to point 166 on the neutral line. Switch 162 is connected at one side to the point 156 and at the other side via line 168 to point 170 on the neutral line.

The switches 144, 146, 160 and 162 may be of the conventional semiconductor type used in regulating circuits, or equivalents.

An energy proportional clamp 172 is connected in parallel with the primary winding via lines 174 and 176.

There are several other circuit blocks shown in FIG. 4, all of which are standard circuits which are well known in the art, and which may be easily constructed of readily available integrated circuits or individual components. Consequently, no detailed circuit description is required. Specifically, a power supply 178 is provided for supplying all internal DC operating voltages. The input power for the supply is obtained from the AC input power, via lines 180 and 182. The power supply may include a circuit to provide a warning signal in case of either power failure or internal damage which may have caused fuse 136 to blow. This warning signal circuit may include a switching device, 184, and output lines 186 and 188 to a suitable warning device.

A Strobe Circuit 190 is connected to the AC power via lines 192 and 194. The Strobe Circuit may be designed to respond either to the AC voltage or current waveform to detect zero voltage or zero current crossings of the AC power, both of them occuring twice during each cycle. The Strobe circuit generates a logic, strobing pulse whenever the respective zero crossings occur. The strobe pulse connects via line 196 to a gate circuit 198.

A voltage error sense circuit 200 connects via lines 210 and 212 to the output lines, 118 and 126. This circuit monitors the output voltage, compares it to some internal reference potential, and determines whether the output voltage is within predetermined limits, or if any correction has to be made. If any correction is required, the error sense circuit produces an output control signal on line 214, indicating in which direction the correction has to be made. This signal connects via line 214 as a second input to the gate circuit 198.

The gate circuit 198 processes the signals from the strobe and sense circuits in such a manner that two possible output commands or signals can be generated, UP or DOWN. These two commands connect via lines 218 and 220 to a three-stage, bidirectional counter 224. Since these two commands are gated by the strobe circuit, they can only occur at the zero crossing, and there can exist only one of them at a time, or none.

The bidirectional counter has three stages 226, 228 and 230, and has a configuration so that only one of them can produce an active output at any one time. Once a given counter stage has been set active, it will remain active until a command from the gate circuit forces a different stage to become active, and such change of active states can only occur at the zero crossing times. Therefore, the three counter stages are simultaneously serving as memories. The three counter stages are identified as LOW (226), MID (228) and HIGH (230), to represent three different operating modes of the device.

When the LOW stage (226) is active, it provides two output commands which are represented by output lines 232 and 234. Line 232 is a switch control line which forces switching device 160 to close whenever 226 has an active output. The second output, line 234, connects to an isolating inverter circuit 236, which produces an isolated DC output which is used to activate switching device 146. The isolating inverter transformer is shown symbolically as 237 and the isolated DC output is represented by lines 238 and 240. Thus, whenever the LOW stage is active, switching devices 160 and 146 will be closed, i.e. opposite end switches of the first and second switch pairs.

The MID stage, 228, provides two output commands shown as lines 242 and 246 where line 242 is a control line which activates switching device 160 and 246 is a control line which activates switching device 162. Thus, whenever the MID stage, 228 has an active output, both switching devices of the second pair close.

The HIGH stage, 230 also provides two output commands, represented by lines 248 and 250, both of them being active whenever the HIGH stage has an active output. Line 248 connects to an isolating inverter circuit 252 which produces an isolated DC output whenever an active command exists on line 249. The isolating inverter transformer 254 is shown symbolically, and the two output lines 256 and 258 provide isolated DC power to activate switching device 144. Output line 250 is a control output which activates switching device 162. Thus, whenever the HIGH stage has an active output, the two switching devices 144 and 162 are activated, i.e. closed.

The circuit operates as follows:

Assume that power was previously turned on, that the input power is far below the "nominal" level, and that the circuit is operating in a steady operating mode where the counter is in its LOW state and the voltage sensing or error sense circuit 200 produces no output signal, i.e. the output voltage is boosted to well within the predetermined limits of the error sensing circuit. Under this condition, the LOW stage 226 produces an active output so that switches 160 and 146 are activated, i.e. closed. Current will flow from input port 100 through line 116 through a portion of winding 114 to tap 132 through line 134. fuse 136, line 138, resistor 140, switch 146, line 158, through winding 122, then through line 148, through switch 160 and line 164 to point 166. This point is the connection on the circuit common line 126, which provides the return path to the second input port, 110, and that is the Neutral power input.

Figure 5:
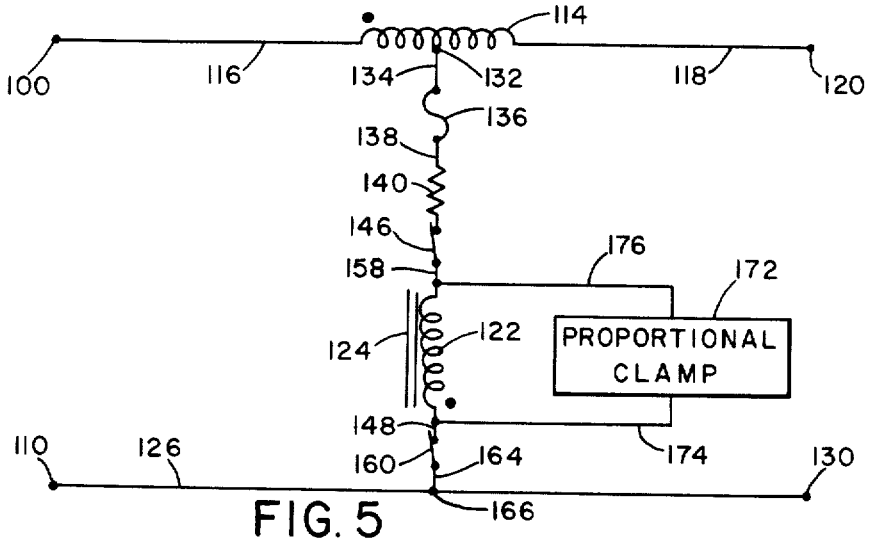
FIGS. 5, 6 and 7 are schematics showing the three different possible operating configurations of the regulator of FIG. 4.

This current path is shown in detail in FIG. 5 where all other components and circuits have been omitted for clarity. It can be seen that this configuration constitutes a boost-mode autotransformer. FIG. 5 also shows clearly how the energy-proportional clamp is connected in parallel to the winding 122. The purpose of the clamp as well as the fuse and resistor is explained further below. It may be assumed at this time that their influences on circuit operation can be ignored.

The boost ratio of the circuit in FIG. 5 is a function of turns ratio between windings 114 and 122 and the particular location of the tap 132 along winding 114. If it is assumed that the turns between starting line 116 and the tap 132 are=A, the turns from the tap 132 to the output line 118 are=B, and the turns of winding 122 are=C, the boost ratio will be:

$$(A+B):(C-A)$$

This interrelationship between windings on a transformer is in full accordance with basic transformer theory. The actual tap connection 132 is not limited to a location between the start and finish of winding 114, as shown, but it may also be located at any point below or above the indicated start or finish lines by simply having additional turns on winding 114 which increase or decrease the net AC voltage which is then connected to the winding 122. It is to be understood, however, that the total number of turns on winding 122 is substantially larger than the turns on 114, typically perhaps in the order of 10:1. Thus, when the LOW stage (226) of the counter (224) has an active output, the transformer will be terminated in a manner which produces a voltage boost at the output ports 120 and 130.

Figure 6:
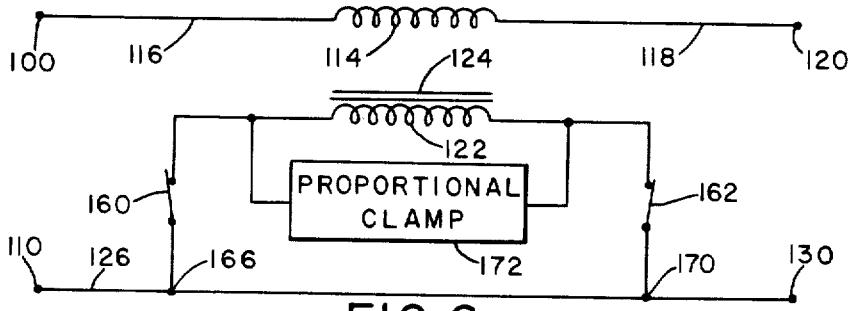

Assume now that the input AC power increases its voltage level to a larger amplitude, and the previously described boost mode produces an output voltage which exceeds the desired limits. The error sensing circuit, 200, detects this deviation instantly, and a signal is produced on line 214 to indicate to the gate circuit (198) the required direction of change. The gate circuit is strobed by the next following zero crossing from strobe generator 190, via line 196, and initiates an UP count pulse on line 218. The counter advances at that instant to its next stage, which is the MID stage, 228. As the MID stage becomes active, the LOW stage, 226, becomes inactive at the very same instant, and the two switch control lines 232 and 234 become disabled. Instead, the MID stage provides two control outputs, via lines 242 and 244, to activate switches 160 and 162. The active circuit components of this configuration are shown in FIG. 6.

AC input power is connected to ports 100 and 110. Current will then flow through the buck/boost winding 114 to the output port 120, from there through the load to port 130, and through line 126 to the second input port, 110 which is the return path to the AC input Neutral. Both switches, 160 and 162, are now closed so that a short circuit path exists across winding 122. This path is, starting from point 166 through switch 160, to one end of winding 122. The other end of winding 122 connects to switch 162 through the closed switch to point 170, and point 170 connects to the common line 126 which feeds to the common starting point, 166. Thus, a short circuit path exists across winding 122 and this short circuit is reflected by the mutual inductance of the two windings into the buck/boost winding 114. Since winding 122 is the primary winding which has perhaps ten times the number of turns as the winding 114, the short circuit is reduced by the impedance ratio of the two windings which is then in the order of 100:1. Thus, winding 114 appears like an extremely low impedance short circuit between the input and output ports so that virtually no losses occur in the transformer. It should be noted that in this configuration, winding 122 is not energized by the input AC power. And since the winding 114 introduces neither buck nor boost or losses, the output voltage between ports 120 and 130 is exactly the same as the input voltage at ports 100 and 110. In this configuration, the regulator operates in the straight through mode like a solid state switch, i.e. output is equal to input.

Assume now that the input voltage increases even further, and the output sensing circuit 200 detects that the output voltage is now above the predetermined limit. The error sense circuit provides then a corresponding signal to the gate circuit, 198 via line 214, and the gate produces an UP command upon the very next strobe pulse from line 196. The UP command feeds via line 218 to the counter 224, and the counter advances to the HIGH stage 230. The MID range becomes inactive because the switch activating commands on lines 242 and 244 interrupt, and instead switch activating lines 248 and 250 now energized by the HIGH stage, 230.

Line 248 energizes the isolating inverter 252 so that switch 144 is now being closed, and line 250 activates switch 162. The conditions which exist under this condition are shown in detail in FIG. 7. It can be seen that winding 122 is now connected to the tap 132 in the opposite direction to FIG. 5.

The load current is now flowing from input port 100, through line 116, through the buck/boost winding 114, through line 118 to the output port 120, which is the input to the load. The return current from the load connects via port 130 to the Neutral input. The energizing power for the primary winding is derived at tap 132 and flows through line 134, fuse 136, line 138 resistor 140 through switch 144 and line 152 to one end of winding 122. The other end of winding 122 connects to switch 162 and through it and line 168 to point 170, which is located on the common Neutral line 126. The conventional dots adjacent to the windings show the winding direction, and the transformer is now connected as a step down auto transformer. Assuming again that winding 114 has the two segments A and B, A being the input portion from the line 116 to the tap 132, and B being the output portion between tap 132 and output line 118, and assuming that winding 122 is again equal to C, the transformer will have a step down ratio which is defined by the ratio of:

$$(A+B):(A+C)$$

This relationship is also basic transformer theory, and the output voltage will now be less than the input. As in the discussion of FIG. 5, it may be assumed that the resistor 140 and fuse 136 have no significant influence on the operation in any of the mode which have been described thus far.

Thus, there are three operating modes which can provide boosted, straight through, or bucked transformer operation. If the input voltage decreases beyond a predetermined level, or guard band, it will be detected by the error sense circuit, 200 and the gate circuit 198 will then produce a DOWN command on line 220 forcing the counter to step back to the next lower counter stage.

The apparatus or circuit described so far constitute an AC voltage regulator which requires only one single primary winding which determines the operating mode by its switch-controlled winding direction and termination. In accordance with basic autotransformer theory, the energizing current which flows through the primary winding is a well defined small fraction of the actual load current as determined by the turns ratio. Thus the regulating apparatus is smaller, lighter and less expensive on materials than primary switching regulators requiring three primary windings.

In order to simplify the discussion of the previous circuits, the winding tap 132 has always been shown to be located at a point between the input line 116 and output line 118. However, all basic theories of transformers apply to this circuit, and winding 114 may be rearranged in a multitude of configurations to produce the same or equivalent result. For example, the connections from the tap 132 and the end of the winding which is shown to connect to the output line 120 could easily be interchanged. Alternatively, the tap connection may also be interchanged with the start of the winding which is now shown to connect to the input line 100. Such connections will achieve a skew in the regulator's operating range to favor either brown out or overvoltage inputs.

In the earlier description of the failure modes of regulators of prior art it was shown that there exists a momentary condition at the time of power up where there is no operating power in the regulator until sufficient potential has been developed by the internal power supply. It was also shown that at that initial moment, all switching devices are non-energized, i.e. they are open circuits.

FIGS. 4 to 7 show that there is an energy proportional clamp, 172 which is always connected in parallel to winding 122 via lines 174 and 176 regardless of the state of any of the switches. The function of this energy proportional clamp is to limit the maximum possible voltage and power which may develop across winding 122 when the switches are open and to reduce the voltage limit level of the clamp if the energy of the surge current approaches a damage-causing magnitude. The energy-proportional clamp is a two-terminal circuit which can conduct current in either direction and which limits the voltage across the primary winding to below several predetermined values. Thus, it is an energy-proportional AC clamp. The structure of this device is shown in FIG. 8 as connected in parallel to winding 122.

Figure 8:
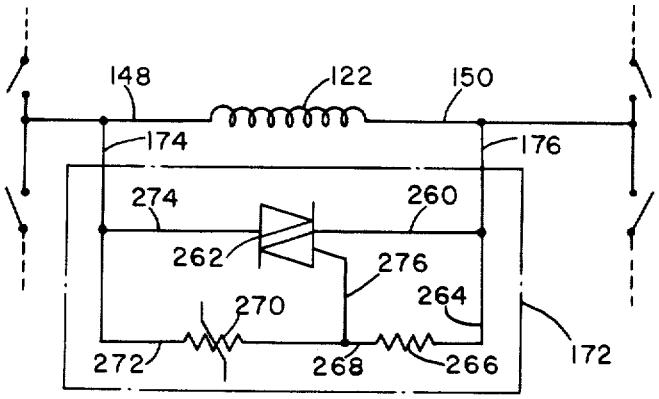
FIG. 8 is a schematic diagram showing a preferred configuration of the energy proportional clamp of FIG. 4.

With reference to FIG. 8, the two terminals of the clamp 172 are represented by lines 174 and 176. The clamp comprises a network across the primary winding consisting of a varistor or transient suppressor 270 in series with a low impedance resistor 266 and a parallel thyristor 262 which is triggered from the common varistor and resistor node 268. Line 176 provides two connections, via line 260 to the COMMON terminal of Thyristor (Triac) 262 and via line 264 to resistor, 266. The resistor connects via node 268 to a transient suppressor or varistor 270, which may be a Metal Oxide Varistor (MOV), or an equivalent semiconductor surge suppressor. The other end of the suppressor connects via line 272 to the second input terminal line 174. Also connected to the input line 174 is the HIGH terminal of the Thyristor, via line 274. This circuit operates as follows:

Assume an initial standby state where none of the elements are conducting any current. Any AC voltage which appears across winding 122 is applied to the two clamp terminals, lines 174 and 176. As long as this voltage is below the critical conductio knee of the suppressor, no current will flow through the suppressor, and no trigger current can flow out into the GATE of the Thyristor 262. This critical conduction knee may be at about 200 V which is slightly higher than the ordinary peak voltage of the 120 V power line sinewave. If, however, a voltage is induced into winding 122 which exceeds this critical level, the suppressor will start conducting. The current which flows now through the suppressor is terminated by resistor 266 which connects to the terminal 176. The current which flows through the resistor will develop a dropping voltage which is proportional to the suppressor current. The internal impedance of the suppressor 270 changes to a low state when it conducts, and thus, the series connected suppressor and resistor become the initial terminating impedance across winding 122. Since winding 122 has mutual inductance with winding 114, a low impedance is now reflected into the buck/boost winding 114 as an impedance whose value is reduced by the impedance ratio of the two windings. The response time of typical surge suppressors in this mode is in the order of a few nanoseconds, and this speed is adequate for the initial protection of open switching devices.

If the surge current is of a larger magnitude it will develop a voltage drop across resistor 266 which then becomes large enough to forward bias the GATE of the Thyristor via line 276. The internal structure of a Thyristor has a GATE-to-COMMON diode junction which starts conducting as soon as it becomes forward biased. There is virtually no time delay. However, there is a time delay in the Thyristor until the MAIN, or HIGH terminal begins any conduction at all. This delay is called Gate Controlled Turn-On Time, and requires typically in the order of approximately 3 microseconds. During this relay time, the GATE junction is capable of conducting very large currents while it is clamping the actual voltage which can develop across it. Typical devices can easily absorb some 40 joules of energy during this delay time. While the GATE is conducting this current, it has a very low impedance which is in series with the suppressor's (also low) impedance, so that now the two series-connected, low impedances are reflected into the buck/boost winding as an even much lower impedance, due to the winding's impedance ratio.

During all this time, perhaps 3 microseconds, the Thyristor has not yet latched, and if the surge current is a pulse of shorter duration, all conduction through the energy proportional clamp will stop at that time. However, if the surge current is large enough, and lasts for a long enough period of time, the Thyristor will latch and start conducting from the MAIN to the COMMON terminal, or vice versa, depending on the polarity of the surge current. When this occurs, it should be obvious that the Thyristor constitutes a virtual short circuit across the primary winding 122. In this mode, the Thyristor can conduct several hundred Ampere, and since this is a function of transformer turns ratio, it can easily accomodate several thousand Ampere flowing through the buck/boost winding, without permitting any excessive voltage rise across winding 122. If all excessive voltages across the primary winding are prevented during this turn-on surge period, it follows that no damaging voltage surges can appear across any of the switching devices.

It can now be seen that the energy-proportional clamp responds in several different ways, providing a progressively decreasing clamping impedance as a function of the amount of energy which it is exposed to.

Whenever the surge energy is large enough to cause actual latching of the Thyristor, it will remain latched until the current through it decreases below its own "holding" current. Since the input power to the regulator is an AC voltage waveform, the current must cross the zero current axis twice each cycle. Therefore, the longest period of time that the Thyristor can be latched up is one half cycle at a time. With reference to FIG. 4, if the internal power supply of the regulator provides operating power during such latch-up condition, two of the four switching devices will be turned on. If either the HIGH or LOW counter stage is turned on at that time, it can be seen in FIG. 5 and FIG. 7 that the input AC power is then also connected to the primary winding 122, via fuse 136 and resistor 140. The resistor value is chosen so that the maximum possible current which can flow through the switches at that time is limited by the resistor to a safe value that is within the surge ratings of the particular switching devices. This maximum surge current is called "Peak One Cycle Surge" and is typically several hundred Ampere. Consequently, the actual Ohmic value of resistor 140 is very small because this particular current is determined by the maximum input line voltage, and has no relationship to the turn-on surge currents of the load which are being clamped via the clamping path, directly across the winding 122. Thus, there are two separate current paths. One of them is directly across primary winding 122 through clamp 172, without using any of the four switching devices; and the other path is from the power input circuit, through resistor 140 where the resistor limits the maximum possible current.

The second failure mode which was discussed at the beginning is also a switching device puncture which can occur during an instantaneous polarity reversal when a heavy load is being switched on. In these circumstances, the energy-proportional clamp 172 will respond in an identical manner. Since this clamp is always connected in parallel with the primary winding, it will automatically, and instantaneously respond as soon as any voltage across it rises to a critical trigger level.

The rating of fuse 136 is chosen so that it will not blow as a result of several, repetitive half cycles of surge latch-ups. The fuse will only blow if there is a permanent circuit malfunction which could cause damage to the transformer or other circuits. If the fuse should blow for any reason, it can be seen from FIG. 4 that this would remove operating power from the internal power supply, and a suitable warning output signal, perhaps via a relay 184 may then become activated.

It can also be seen that if fuse 136 should blow for any reason, the system will still provide operating power to the load, even though none of the switching devices can be activated under that condition. However, the load current which flows then through winding 114 is inducing a voltage into winding 122. Since the switches are open, the induced voltage will rise rapidly at the beginning of each half cycle so that the clamp 172 gets triggered and latches until the next zero current crossing. This repeats every half cycle so that the overall performance becomes very similar to the ordinary MID range characteristic, i.e. the output voltage will be equal to the input voltage. Of course, there will be no detection of the output voltage error and there will be no voltage regulation. And since there is no interruption of output power, the warning indicator 184 will alert the operator. This constitutes an automatic, and safe bypass mode which maintains operating output power in case of an internal failure while an operator is alerted of the existing condition.

Figure 7:
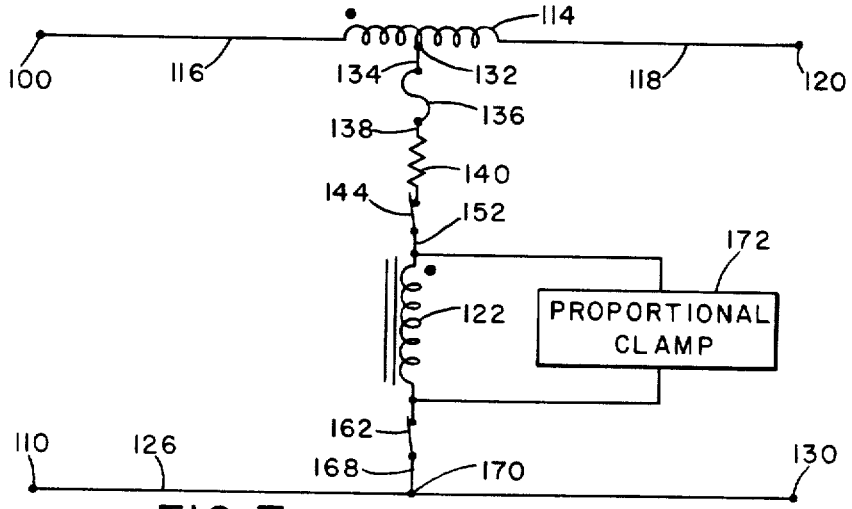

In all previous discussions, a tap 132 was shown on winding 174 and a resistor 140 was shown in the input connection to the primary switching devices. The previous discussions have shown that the actual current which is flowing from the tap to the primary switching circuit is significantly less than the current which flows through the winding to the load. The reduction of current is due to and in accordance with the turns ratio. It must be understood that the turns on the buck/boost winding, 114 are wound with extremely large wire. With large wire, it is relatively cumbersome and expensive to make tap connections. This is particularly objectionable if the tap serves only to conduct relatively small currents. Similarly objectionable is the use of an ordinary resistor to achieve the protective current limiting function of the device 140 as shown in FIGS. 4, 5 and 7. This resistor would have to be a power resistor of considerable physical size to withstand the momentary surge currents which can occur when there is a multiple switch latch up for perhaps one, or several successive half cycles. This condition was discussed earlier.

Figure 9:
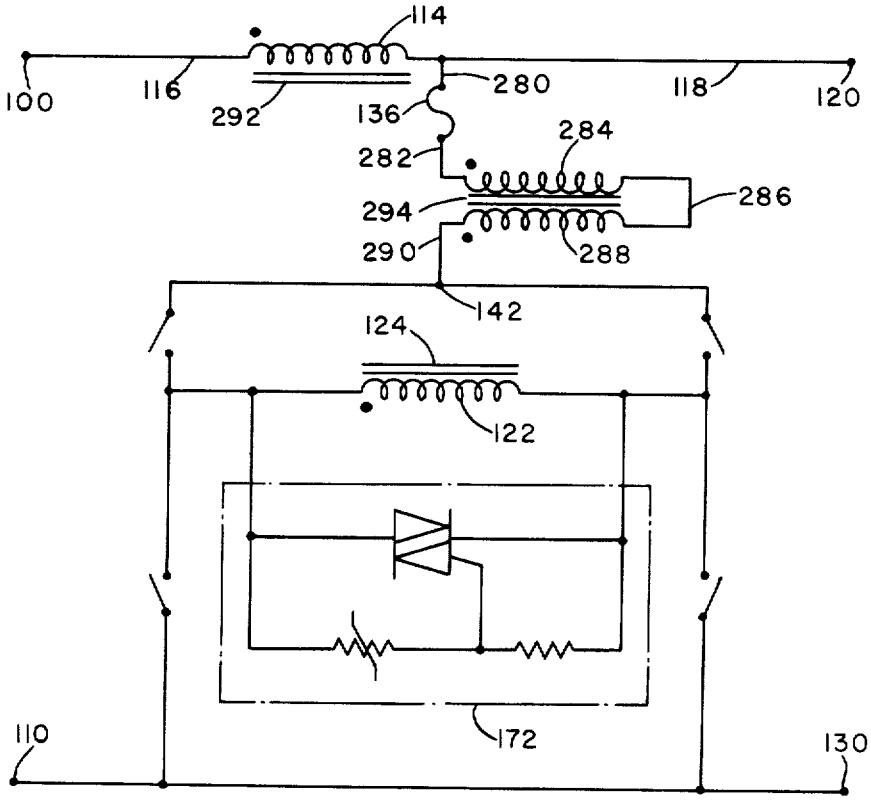
FIG. 9 is a more detailed schematic diagram showing a modification to the regulator of FIG. 4.

It is, however, possible to combine the functions of the tap and the resistor into an additional transformer winding which is also wound onto the same transformer core, together with windings 114 and 122. This modification is shown in FIG. 9. Instead of connecting the fuse 136 to a tap, it connects now via line 280 to the output line 118. The fuse feeds through line 282 to a third winding which is shown in three separate segments 284, 286 and 288. The end of segment 288 feeds via line 290 to the switch interconnecting point 142. The remainder of the primary switching circuit is identical to all other drawings.

This circuit functions as follows:

The physical length and wire size of winding 284, 286 and 288 is chosen to have an Ohmic resistance which is exactly equal to the resistance value of resistor 140 in FIG. 4 and whose current carrying capability is adequate for the surge current considerations involved.

The turns of the input portion, 284 are wound in a given first direction which is the same as the direction of winding 114. This is indicated by the conventional dots adjacent to the windings. The apparent finish of the turns of 284 is shown as a line 286. At that point, the direction of the winding becomes reversed so that it continues from there as portion 288 in a second direction, which is opposite to the direction in the first part 284. If the numbers of turns in both parts 284 and 288 is identical, it would cause a complete cancellation of the voltage which is induced into this winding. Thus, lines 282 and 290 would always be at the same potential. This is in full accordance with basic transformer theory. But assume now that the portion shown as 288 has a greater number of turns than portion 284. Since the mutual inductance between all windings on a common transformer core establishes a fixed volt-per-turn condition on all windings, each one turn on any winding is equivalent any one turn of any of the other windings. Therefore, if there are more turns on portion 288 than on portion 284, the additional turns on portion 288 (connected to line 290) are equivalent to an equal number of turns on winding 114. Thus, if the number of the additional turns on portion 288 is chosen to be exactly the number of turns which was shown in FIG. 4 as a portion of winding 114 between tap 132 and output line 118 then the end of the winding portion 288 is exactly equivalent to tap 132 of winding 114.

The ratio of forward to reverse turns on winding 284–288 can be arranged in any manner so that the end line, 290 can become equivalent not only to taps along winding 114 but it can also become equivalent to additional turns ahead of the start, or beyond the end of winding 114. Thus there may be an equal number of forward and reverse turns, less forward turn than reverse turns, or less reverse turns than forward turns in any chosen ratio.

The windings are all wound on a common transformer core shown in FIG. 9 as the conventionals symbolic lines 292, 294, 124 and it is to be understood that although they are shown separately to indicate mutual inductance, they all represent the same transformer core. Thus the unique winding characteristic or winding 284–288 combiines the functions of a resistor and a transformer tap of a different winding.

Thus the arrangement of FIG. 9 avoids the necessity of providing a tap on the back/boost winding, and replaces the resistor for withstanding momentary surge currents.

Figure 10:
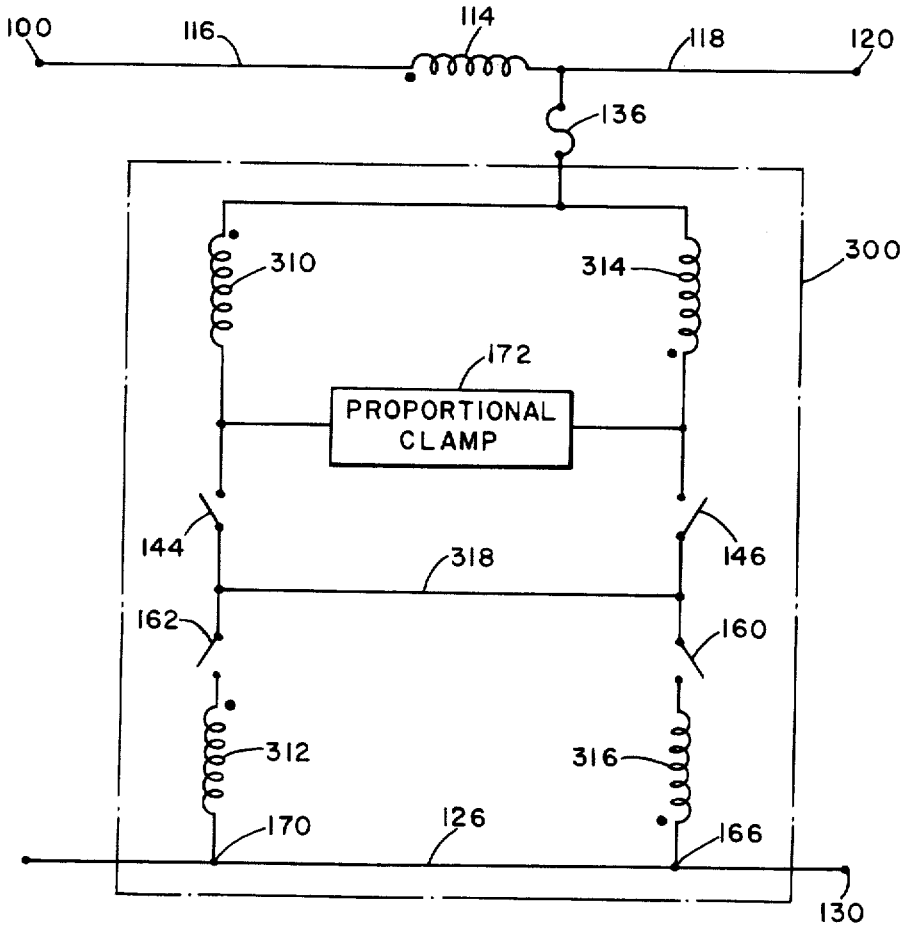
FIG. 10 is a schematic diagram showing an alternative switching arrangement for the voltage regulator according to another embodiment of the invention.

FIG. 10 shows an alternative switching assembly 300 for use in a modified embodiment of the invention to replace the assembly 128 of FIG. 4. In FIG. 10 some of the circuit components are equivalent and have similar functions to those described above, and like reference numerals have been used where appropriate. In the embodiment of FIG. 10 identical sensing circuitry and control devices (not shown) to those shown and described in connection with FIG. 4 will be used for selectively closing switches 144, 146, 160 and 162, and this part of the circuit will therefore not be shown or described again in detail with reference to this embodiment. One difference in FIG. 10, however, is the new switching arrangement which terminates all four switches to a floating circuit common line 318, eliminating the need for isolators 236 and 252 of FIG. 4 and thus significantly simplifying the circuit and making the switch assembly easier to service.

In the arrangement of FIG. 10, the input of switch assembly 300 is shown connected to the output end of the buck/boost winding 114 via fuse 136. However, it may alternatively be connected to the input end or an intermediate tap point of the winding 114, as described above with reference to FIGS. 4 and 9.

The primary winding in FIG. 10 is made up of two oppositely wound portions, each portion being split into two winding parts 310, 312 and 314, 316, respectively. Switches 144 and 162 control connection of part 310 and part 312 in series, while switches 146 and 160 control connection of parts 314 and 316 of the oppositely wound portion in series in the circuit. The total number of turns of each of the oppositely wound portions of the primary winding will be arranged to have a suitable turns ratio with the buck/boost winding as described above, for example of the order of 10:1 or more. Each part of each of the winding portions may have an equal number of turns, or different number of turns may be used in alternative arrangements.

An energy proportional clamping circuit 172, which is preferably identical to that described above in connection with FIGS. 4 and 8, is connected between the switch ends of winding parts 310 and 314 of the oppositely wound portions of the primary winding.

As mentioned above, the circuitry will be the same as that described above in connection with the previous embodiments, apart from the specifically noted differences. Additionally, the protective resistance provided at 140 in FIG. 4 and in the bidirectional winding of FIG. 9, is designed into the split primary windings in this embodiment.

Operation of the switching assembly of FIG. 10 is as follows. For the purposes of the following description, it will be assumed that the buck/boost winding has A turns, and the primary winding parts 310, 312, 314 and 316 have P1, P2, P3 and P4 turns, respectively. Clearly the sum of P1 and P2, and the sum of P3 and P4, will each be equal to substantially more turns than the buck/boost turns A.

Referring back to the switch controlling circuitry of FIG. 4, assume first that switches 146 and 160 are activated or closed by an output from counter stage 226. This is the so-called boost mode in which the output voltage is well within the predetermined limits of the error sensing circuit. The winding parts 314 and 316 are now connected in a boost configuration with the buck/boost winding 114 and common circuit line 126. The boost ratio in this condition will be:

$$A:P3+P4-A$$

If both switches 144 and 162 are closed by an output from counter stage 230, which occurs when the output voltage is above the predetermined limit, the oppositely wound parts 310 and 312 of the primary winding will instead be connected between buck/boost winding 114 and the circuit common line 126. The circuit will then operate in the buck, or step down mode, with a boost ratio of:

$$A:A+P1+P2$$

Thus winding parts 310 and 312 in FIG. 10 together comprises a buck winding.

Between these two extremes the switches 160 and 162 will be closed by an output from counter stage 228, so that there will be a short circuit across primary winding parts 312 and 316 to the common line 126. In this situation the circuit operates in the straight through mode with the output voltage being equal to the input voltage, as described above in connection with FIG. 4.

Thus, as in FIG. 4, switches 146 and 160 control boost mode operation, switches 144 and 162 control buck mode operation, while switches 160 and 162 control straight through operation.

As in the previously described embodiments, a single switch assembly is provided to allow three different possible switch configurations for producing boost, buck, or straight through transformer operation. This assembly is simpler than those of the previously described embodiments, and does not require the two switch isolators which can prove awkward to assemble and difficult to service in the equipment.

The energy proportional clamp 172 is connected across the split primary windings, with the two parts 310 and 314 of the split primary windings across which it is connected being equivalent to the single primary winding 122 in FIG. 8. Thus the operation of the clamp 172 will be identical to that described in connection with FIG. 8, with winding parts 310 and 314 replacing the single winding of that Figure. Thus the clamp 172 operates to limit the voltage and power across the primary winding regardless of the state of any of the switches. For example, any AC voltage which appears across primary winding portions 310 and 314 will be applied to the opposite terminals of clamp 172.

As in FIG. 8, the clamp operates in three stages according to the existing conditions. In the event of induced voltages in the primary windings exceeding a critical level, (that of varistor 270) the clamp 172 starts conducting to provide a terminating impedance across the primary winding portions. In the event that the gate diode triggering voltage is exceeded, the gate junction conducts voltage to provide an impedance in series with the varistor across the primary portions 310 and 314. If the thryristor is latched, a virtual short circuit is provided, i.e. the clamp voltage is effectively zero. Thus, as in the previous embodiment described above, the energy proportional clamp acts to limit the voltage and power across the primary winding to below several predetermined values, according to the existing circuit conditions. The AC line voltage regulator describe above can therefore have equivalent efficiency to previous transformer switching regulators, while avoiding some of the problems inherent in such regulators and requiring only a single primary winding.

Although a preferred embodiment of the invention has been described above by way of example, it will be understood by those skilled in the field that modifications may be made to the disclosed embodiment without departing from the scope of the invention which is defined in the appended claims.

I claim:

1. An apparatus for regulating an AC line voltage, comprising:

an input port for connection to a source of input AC voltage;

an output port for delivering a regulated voltage to a load;

transformer means for regulating the output voltage, comprising a buck/boost winding connected between the input and output port, a primary winding split into two oppositely wound portions each having a greater number of turns than the buck/boost winding, each primary winding portion being split into at least two winding parts and a common transformer core about which both windings are wound;

switch means for controlling the connection of the primary winding in circuit with the buck/boost winding, including means for selectively connecting the primary winding in different configurations in the circuit the switch means comprising first switch means for controlling connection of the two parts of one of the primary winding portions in series in the circuit in a first, boost configuration, and second switch means for controlling connection of the two parts of the other winding portion in series in the circuit in a second, buck configuration;

voltage sensing means for detecting the magnitude of the line voltage and for producing corresponding control signals when the line voltage varies outside predetermined limits; and switch controlling means responsive to the voltage sensing means control signals for closing said first switch means if the voltage is below the predetermined limits and closing said second switch means if the voltage is aboe the predetermined limits, the transformer means comprising a step up transformer in the first configuration and a step down transformer in the second configuration; and energy proportional current and voltage limiting means for limiting the current and voltage across the primary winding.

2. The apparatus as claimed in claim 1, wherein the energy proportional current and voltage limiting means comprises a multi-level conduction energy proportional clamping means connected across one winding part of each of the primary winding portions for limiting the voltage and power across the primary winding to below several predetermined values.

3. The apparatus as claimed in claim 2, wherein the energy proportional clamping means comprises a network, the network comprising a varistor in series with a resistor, and a thyristor connected in parallel with the varistor and resistor which is triggered from the common varistor and resistor node.

4. The apparatus as claimed in claim 1, including a circuit common line having an input port for connection to a neutral power input;

the first and second switch means comprising first and second pairs of switches, and the switch controlling means comprising means for closing the first pair of switches in response to a voltage below the predetermined limits, means for closing the second pair of switches in response to a voltage above the predetermined limits, and means for closing one switch of each pair to terminate one part of each of the winding portions to each other in response to voltages within the predetermined limits.

5. The apparatus as claimed in claim 4, wherein the voltage sensing means includes error sensing means for providing an up or down condition signal when the line voltage varies by a given magnitude up or down from a set voltage to be regulated, zero crossing detector means for producing output signals at half cycle zero crossings of the line voltage, and gate circuit means responsive to both the error sensing means and zero crossing detector means for providing a corresponding up or down switch signal comprising said control signals to said switch controlling means at each zero crossing when the line voltage has varied up or down from the given magnitude.

6. The apparatus as claimed in claim 5, wherein the switch controlling means comprises counter means having successive low, mid and high stages, the counter means being responsive to up switch signals to advance from one stage to the next between the low and high stage and being responsive to down switch signals to step back between stages in the opposite direction, each of the stages having control outputs for controlling actuation of the switches, the low stage having control output means for controlling actuation of the first pair of switches, the high stage having control output means for controlling actuation of the second pair of switches, and the mid stage having control output means for controlling actuation of one switch of each pair.

7. The apparatus as claimed in claim 4, including a line to which all four switches are terminated.

8. The apparatus as claimed in claim 1, wherein one end of each of the winding portions is connected to the same circuit point relative to the buck/boost winding, the circuit including a common line for connection to a neutral power input, the opposite end of each winding portion being connected to the common line.

9. The apparatus as claimed in claim 1, wherein the energy proportional current and voltage limiting means comprises a multi-level conduction, energy proportional clamping device connected across one part of each of the primary winding portions.

10. The apparatus as claimed in claim 1, wherein the switch means is connected to the buck boost winding via fuse means for removing operating power from the circuit in response to predetermined circuit malfunctions.

11. The apparatus as claimed in claim 1, wherein the buck/boost winding has an intermediate tap point, and three connector points connected to the input port, the switch means, and the output port, respectively, one of the connector points being connected to the tap point with the other two connector points connected to respective opposite ends of the buck/boost winding.

12. The apparatus as claimed in claim 1, wherein a further winding wound around the common transformer core is connected between the buck/boost winding and switch means, the further winding having a first portion wound in the same direction as the buck boost winding and a second portion wound in the opposite direction to the first portion.

13. The apparatus as claimed in claim 12, wherein the second portion of the further winding has a greater number of turns to the first portion.

14. The apparatus as claimed in claim 12, wherein the second portion of the further winding has less turns than the first portion.

15. The apparatus as claimed in claim 12, wherein the first and second portions of the further winding have an equal number of turns.

16. An apparatus for regulating an AC voltage comprising:

an input port for connection to a source of input AC voltage;

an output port for delivering a regulated voltage to a load;

a neutral line;

transformer means connected between the input and output port for controlling the output voltage level, comprising a buck/boost winding, a primary winding having more turns than the buck/boost winding, and a common transformer core about which both of the windings are wound, the buck-/boost winding being connected between the input and output port;

switch means for controlling the connection of the primary winding in circuit with the buck/boost winding, comprising a first pair of switches for selectively connecting opposite ends of the primary winding to the buck/boost winding, and a second pair of switches for selectively connecting opposite ends of the primary winding to the neutral line;

voltage sensing means for sensing the voltage level at a chosen point in the apparatus;

switch controlling means responsive to the voltage sensing means for controlling said switches, comprising means for closing one of said first pair of switches and the opposite one of said second pair of switches in response to voltages below a first predetermined level so that said transformer means acts as a step up transformer, means for closing the other one of said first pair of switches and the other one of said second pair of switches in response to voltages above a second predetermined level so that said transformer means acts as a step down transformer, and means for closing both of said second pair of switches in response to voltages intermediate said two predetermined levels, and a further winding connecting between the buck-/boost winding and the first pair of switches, the further winding being wound on the common transformer core and having a first portion wound in the same direction as the buck/boost winding and a second portion wound in the opposite direction to the first portion.

17. The apparatus as claimed in claim 16, including energy proportional clamping means connected in parallel across the primary winding for limiting the voltage across the primary winding to an energy dependent maximum value.

18. The apparatus as claimed in claim 17, wherein said clamping means includes a transient surge suppressor.

19. The apparatus as claimed in claim 18, wherein said clamping means comprises a triac having common and high terminals connected to opposite ends of the primary winding, and a transient suppressor, the triac having a gate and the transient suppressor being connected between the gate and high terminal of the triac.

20. The apparatus as claimed in claim 16, including impedance means connected between the input line and the switch means for limiting the maximum possible current which can flow through the switches to a predetermined safe value.

21. An apparatus for regulating an AC line voltage, comprising:

an input port for connection to a source of input AC voltage;

an output port for delivering a regulated voltage to a load;

a buck/boost winding connected between the input and output port;

a circuit common line with a neutral input port for connection to a neutral power input;

a primary winding assembly for selective connection in a plurality of different possible configurations to a connecting point between the input and output port, the configurations including a boost configuration in which the assembly is connected in circuit with the buck/boost winding to provide a step up transformer, a buck configuration in which the assembly is connected to provide a step down transformer, and a straight through configuration in which the primary winding assembly is terminated itself;

the primary winding assembly comprising a first, boost portion and a second, oppositely wound buck portion, each portion being split into at least two parts, one end of each of the winding portions being connected to said buck/boost winding connecting point, and switch means comprising a first pair of switches connecting the two parts of the boost portion, a second pair of switches connecting the two parts of the buck portion, and a common line connecting all the switches together;

voltage sensing means for detecting the magnitude of the input line voltage and for producing corresponding control signals when the voltage varies outside predetermined limits; and switch controlling means responsive to the voltage sensing means for controlling the switch means to connect the primary winding means in the boost configuration if the voltage is below the predetermined limits, to connect the primary winding means in the buck configuration if the voltage is above the predetermined limits, and to connect the primary winding means in the straight through configuration if the voltage is within the predetermined limits, the switch controlling means comprising means for closing the first pair of switches in response to voltages below the predetermined limits, closing the second pair of switches in response to voltages above the predetermined limits, and closing one switch of each pair to terminate one part of each of the winding portions to each other in response to voltages within the predetermined limits.

* * * * *

UNITED STATES PATENT AND TRADEMARK OFFICE

CERTIFICATE OF CORRECTION

PATENT NO. : 4,716,357

DATED : December 29, 1987

INVENTOR(S) : Edward Cooper

It is certified that error appears in the above-identified patent and that said Letters Patent is hereby corrected as shown below:

Claim 1, column 18, line 24, delete "aboe" and insert therefor -- above --.

Claim 4, column 18, line 48, before "and" (second occurrence) insert -- respectively --.

Signed and Sealed this

Seventh Day of June, 1988

*Attest:*

*Attesting Officer*

DONALD J. QUIGG

*Commissioner of Patents and Trademarks*